US009410681B2

(12) United States Patent
Yao

(10) Patent No.: US 9,410,681 B2
(45) Date of Patent: Aug. 9, 2016

(54) DOUBLE-HEAD LAMP HOLDER AND LAMP PROVIDED WITH SAME

(71) Applicant: RUIAN HENGXIONG ELECTRIC CO., LTD., Ruian, Zhejiang (CN)

(72) Inventor: Xiong Yao, Zhejiang (CN)

(73) Assignee: Ruian Hengxiong Electric Co., Ltd., Zhejiang (CN)

( * ) Notice: Subject to any disclaimer, the term of this patent is extended or adjusted under 35 U.S.C. 154(b) by 0 days.

(21) Appl. No.: 14/889,426

(22) PCT Filed: Jun. 25, 2014

(86) PCT No.: PCT/CN2014/080739

§ 371 (c)(1),
(2) Date: Nov. 5, 2015

(87) PCT Pub. No.: WO2015/180223

PCT Pub. Date: Dec. 3, 2015

(65) Prior Publication Data

US 2016/0146437 A1 May 26, 2016

(30) Foreign Application Priority Data

May 29, 2014 (CN) ..... 2014 1 0233244

(51) Int. Cl.

| | |
|---|---|
| ***H01R 13/02*** | (2006.01) |
| ***F21V 21/00*** | (2006.01) |
| ***F21V 23/06*** | (2006.01) |

(52) U.S. Cl.

CPC ..... *F21V 21/00* (2013.01); *F21V 23/06* (2013.01)

(58) Field of Classification Search

USPC ..... 439/239, 226, 233, 241; 200/329, 336

See application file for complete search history.

(56) References Cited

U.S. PATENT DOCUMENTS

| | | | | |
|---|---|---|---|---|
| 5,113,044 | A * | 5/1992 | Tomberlin | H01R 33/9555 200/51.04 |
| 5,813,155 | A * | 9/1998 | Shen | A47G 1/0622 248/126 |
| 6,768,072 | B1 * | 7/2004 | Yang | H01H 13/58 200/320 |
| 7,491,077 | B1 * | 2/2009 | Yang | F21V 19/006 439/241 |
| 7,521,641 | B2 * | 4/2009 | Huang | H01R 33/9555 200/336 |
| 8,101,878 | B2 * | 1/2012 | Yang | H01H 3/42 200/51.17 |
| 8,491,324 | B1 * | 7/2013 | Yang | H01R 33/0836 439/226 |
| 8,657,614 | B2 * | 2/2014 | Sun | H01R 33/0854 439/233 |
| 8,657,615 | B2 * | 2/2014 | Sun | F21V 19/0085 439/239 |

FOREIGN PATENT DOCUMENTS

| | | | |
|---|---|---|---|
| CN | 2580642 | Y | 10/2003 |
| CN | 1975980 | A | 6/2007 |
| CN | 200950413 | Y | 9/2007 |
| CN | 200976321 | Y | 11/2007 |
| CN | 101527416 | A | 9/2009 |
| CN | 201805127 | U | 4/2011 |
| CN | 203615289 | U | 5/2014 |
| CN | 203871619 | U | 10/2014 |

* cited by examiner

*Primary Examiner* — Alexander Gilman
(74) *Attorney, Agent, or Firm* — Christensen Fonder P.A.

(57) ABSTRACT

A double-head lamp holder and a lamp provided with same. The lamp comprises a junction box and the double-head lamp holder. The lamp holder comprises a housing, a mounting seat is arranged in the housing, a first contact sheet and a second contact sheet that is attached to a binding post of a lamp source to be mounted are arranged on the mounting seat, a turnover flip cover is arranged on the housing, a third contact sheet is arranged on the flip cover, and the cover has an opened first position, and a second position which allows the third contact sheet to communicate the first contact sheet with the second contact sheet when the flip cover is closed.

11 Claims, 5 Drawing Sheets

DOUBLE-HEAD LAMP HOLDER AND LAMP PROVIDED WITH SAME

RELATED APPLICATIONS

The present application is a National Phase entry of PCT Application No. PCT/CN2014/080739, filed Jun. 25, 2014, the disclosure of which is hereby incorporated by reference herein in its entirety.

FIELD OF THE INVENTION

The disclosure relates to a lamp, and particularly to a double-head lamp holder and a lamp provided with same.

BACKGROUND

Global facility horticulture is fast in area development, and a luminous environment control illumination technology for plant growth has aroused attention. For most of planters, a sodium lamp and a metal halide lamp (gas discharge lamps) are optimum light sources instead of sunshine. The metal halide lamp is rich in blue light, which is suitable for initial growth of branches and leaves of plants, and the agricultural sodium lamp is rich in red light and orange light, which has a positive effect on promotion of blooming and resulting of the plants.

Double-end gas discharge lamps are better in light-transmitting performance than ordinary bulbs, are uniform in spectral distribution, and are the most advantageous selection for growth of various crops at present. In the market, there are two kinds of lamp holders suitable for the double-end gas discharge lamps. One is of a rotary clamping type, when a bulb is mounted, this type of lamp holder usually causes that a clamping portion is cracked after the bulb is clamped into the lamp holder, or that the bulb is not rotated and clamped in place after being mounted into the lamp holder, so that the product is not reliable in circuit contact and the potential safety hazards exist. The other one is of a sliding type, which generally includes a housing and a sliding block, and specifically, a binding post for clamping a binding post of a bulb is arranged on the housing, a linear contact sheet is arranged on the sliding block, and after the bulb is mounted, the sliding block allows the linear contact sheet to make contact with the clamping binding post. Since the linear contact sheet and the clamping binding post are in linear contact, larger heat is generated in operation and easily burns other components, and in order to replace the light source, a groove with a width of almost 5 mm needs to be formed on the sliding block, so that a light-source connection wire is able to enter into a binding post or a binding sheet. However, impurities easily fall into the formed groove, and at the formed groove, it is easy to allow conductor metal to directly enter and make contact with the powered-on contact sheets, thus the potential safety hazards in many aspects exist on the product. Moreover, the connected conducting wire is generally arranged on the linear contact sheet, and the defect of unstable contact is usually caused after the sliding block is slid in many times, and also the great potential safety hazards are caused, because the hand needs to be stretched into the groove to borrow force when the sliding block is being slid.

SUMMARY

To solve the problems in the background that a contact sheet of an existing double-head lamp holder is not reliable in contact and potential safety hazards exist, the disclosure provides a double-head lamp holder and a lamp provided with same.

The technical solutions of the disclosure are as follows.

Provided is a double-head lamp holder, including a housing, wherein, a mounting seat is arranged in the housing, a first contact sheet and a second contact sheet that is configured to be attached to a binding post of a lamp source to be mounted are arranged on the mounting seat, a turnover flip cover is arranged on the housing, a third contact sheet is arranged on the flip cover, and the flip cover has a first position which is opened, and a second position which allows the third contact sheet to communicate the first contact sheet with the second contact sheet when the flip cover is closed.

As a further improvement of the disclosure, the second contact sheet is V-shaped, contact planes for making contact with the third contact sheet are arranged on two contact legs of the V-shaped second contact sheet, wave-shaped contact portions are arranged on the third contact sheet, and ends of the contact portions bend outwards.

As a further improvement of the disclosure, an edge that bends inwards is arranged on the first contact sheet.

As a further improvement of the disclosure, a sliding groove is arranged in the housing, a sliding block is arranged in the sliding groove, a clamping portion configured to clamp the lamp source to be mounted is arranged on the sliding block, and the sliding block is matched with the housing in a slide moving manner.

As a further improvement of the disclosure, a resetting spring is arranged in the sliding groove, one end of the resetting spring is clamped with an inner wall of the sliding groove, and the other end of the resetting spring is sleeved on a slide guiding portion of the sliding block and clamped with the sliding block.

As a further improvement of the disclosure, a position limiting seat is arranged on the housing, a position limiting column is arranged on the position limiting seat, a position limiting groove is arranged on the sliding block, and the position limiting column is inserted into the position limiting groove.

As a further improvement of the disclosure, a barb is arranged on the housing, and a clamping groove fitting with the barb is arranged on the flip cover.

As a further improvement of the disclosure, a correcting boss is arranged on an inner wall of the housing at the first contact sheet.

As a further improvement of the disclosure, a wind-guiding inclined face is arranged on the housing.

As a further improvement of the disclosure, a U-shaped baffle plate is arranged on the flip cover.

Also provided is a lamp, including a lampshade in which a junction box is arranged, wherein, the double-head lamp holder described above is arranged on the junction box.

The beneficial effects of the disclosure are as follows. The disclosure provides a turnover flip cover, which allows all the contact sheets and the binding post to be enclosed when powered on, thus the hand is prevented from being stretched into a sliding block, and the potential safety hazards caused when conductor metal directly enters and makes contact with the powered-on contact sheets are avoided. Moreover, a circuit can be fast connected or disconnected through the turnover flip cover, and a lamp source is convenient to overhaul and replace, and also through the turnover flip cover, impurities can be prevented from entering into the housing to affect the power-on performance of the product. In addition, by adopting the lamp of the disclosure, the advantages are as follows: the light source is low in damage rate and convenient to mount, the circuit is connected reliably, the structure is simple and the production cost is low and the like.

In the figures, a housing is denoted by 1; a sliding groove is denoted by 11; a barb is denoted by 12; a correcting boss is denoted by 13; a wind-guiding inclined face is denoted by 14; a mounting seat is denoted by 2; a first contact sheet is denoted by 3; an edge is denoted by 31; a second contact sheet is denoted by 4; a contact leg is denoted by 41; a contact plane is denoted by 42; a flip cover is denoted by 5; a clamping groove is denoted by 51; a U-shaped baffle plate is denoted by 52; a wind guiding portion is denoted by 53; a third contact sheet is denoted by 6; a contact portion is denoted by 61; a sliding block is denoted by 7; a clamping portion is denoted by 71; a slide guiding portion is denoted by 72; a position limiting groove is denoted by 73; a resetting spring is denoted by 8; a position limiting seat is denoted by 9; a position limiting column is denoted by 91; and a junction box is denoted by 10.

DETAILED DESCRIPTION

Embodiments according to the disclosure are further explained below in conjunction with the drawings.

Figure 1:
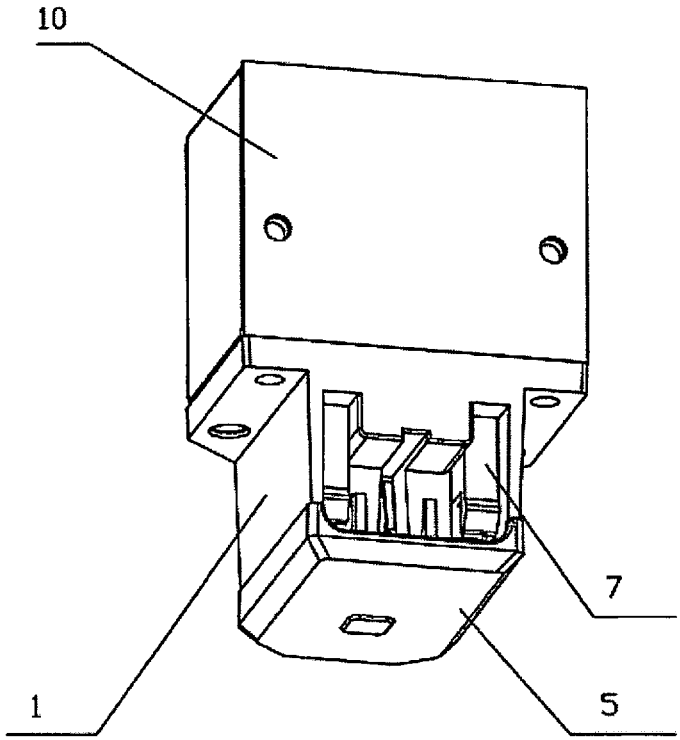
FIG. 1 is a structural schematic diagram of an embodiment according to the disclosure.
Figure 2:
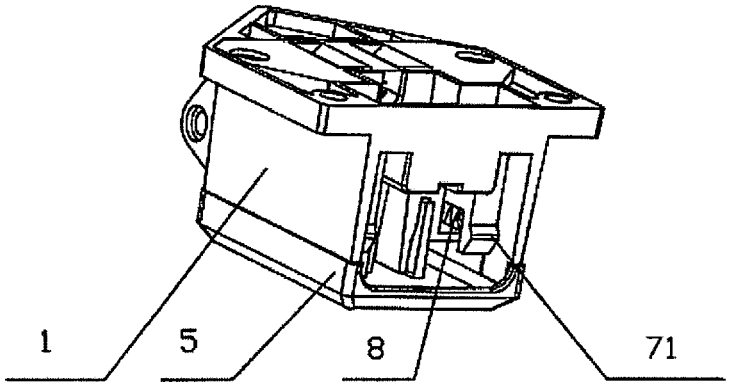
FIG. 2 is a structural schematic diagram after a junction box 10 is removed from FIG. 1.
Figure 3:
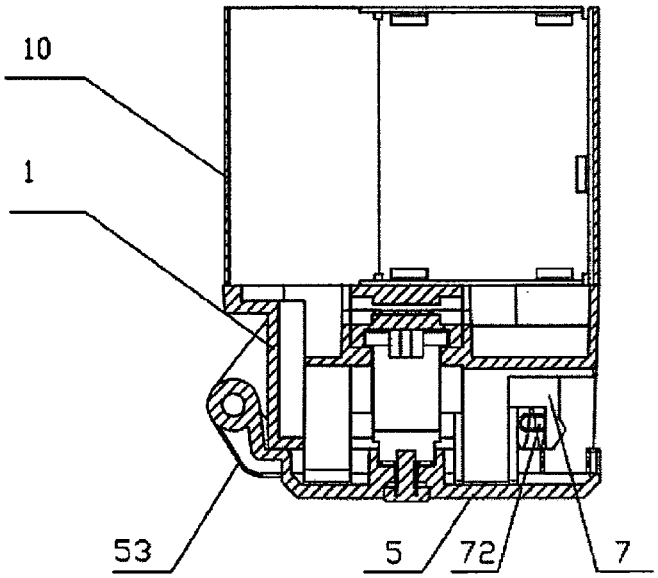
FIG. 3 is a cutaway view of FIG. 1.
Figure 4:
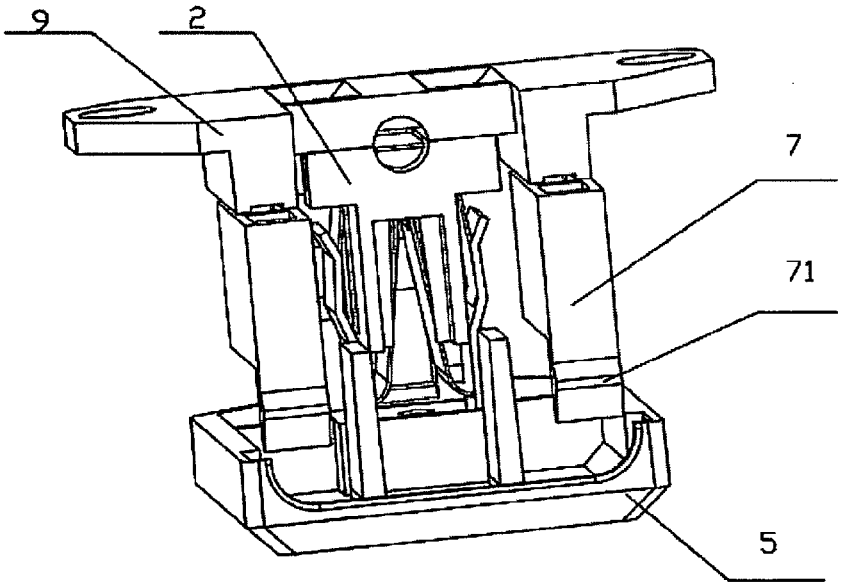
FIG. 4 is a structural schematic diagram after a housing 1 is removed from FIG. 2.

As shown in FIG. 1 and in conjunction with FIGS. 2, 3, 4, 5, 6, 7 and 8, a double-head lamp holder and a lamp provided with same are described. The lamp includes a lampshade in which a junction box 10 is arranged, the double-head lamp holder is arranged on the junction box 10. The double-head lamp holder includes a housing 1, a mounting seat 2 is arranged in the housing 1, a first contact sheet 3 and a second contact sheet 4 that is configured to be attached to a binding post of a lamp source to be mounted are arranged on the mounting seat 2, a turnover flip cover 5 is arranged on the housing 1, a third contact sheet 6 is arranged on the flip cover 5, and the flip cover 5 has a first position which is opened, and a second position which allows the third contact sheet 6 to communicate the first contact sheet 3 to the second contact sheet 4 when the flip cover 5 is closed. The beneficial effects of the disclosure are as follows. The disclosure provides a turnover flip cover, which allows all the contact sheets and the binding post to be enclosed when powered on, thus the hand is prevented from being stretched into a sliding block, and the potential safety hazards caused when conductor metal directly enters and makes contact with the powered-on contact sheets are avoided. Moreover, a circuit can be fast connected or disconnected through the turnover flip cover, and a lamp source is convenient to overhaul and replace, and also through the turnover flip cover, impurities can be prevented from entering into the housing to affect the power-on performance of the product. In addition, by adopting the lamp of the disclosure, the advantages are as follows: the light source is low in damage rate and convenient to mount, the circuit is connected reliably, the structure is simple and the production cost is low and the like. Surely, in the disclosure, a lateral flip cover may also be adopted, which is only bad for the light source at the time of power-on. In addition, surely, the flip cover may also be detachably connected with the housing, which is only trouble in assembling. Accordingly, the present embodiment is the preferred mode of the disclosure. More specifically, the first contact sheet is configured to be connected with a live wire or a zero wire, and the second contact sheet is separated from the first contact sheet. In the case that the flip cover is opened, the second contact sheet and the third contact sheet are not powered-on, avoiding that an operator is shocked by electricity due to his misoperation. In the case that the flip cover is closed, the third contact sheet allows the first contact sheet to be communicated with the second contact sheet, and at this point, the respective contact sheets are surrounded by the housing and the flip cover, avoiding inadvertent touch.

Figure 5:
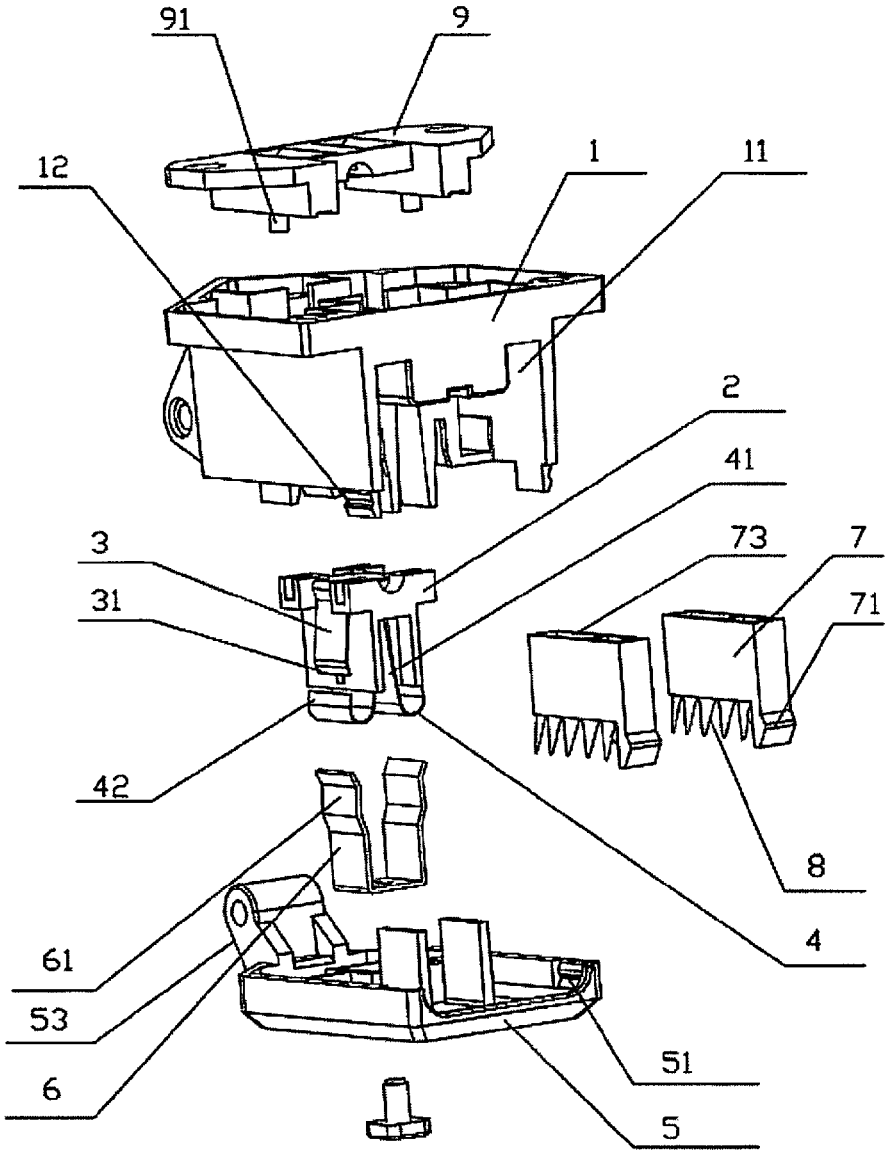
FIG. 5 is an exploded view of FIG. 2.
Figure 6:
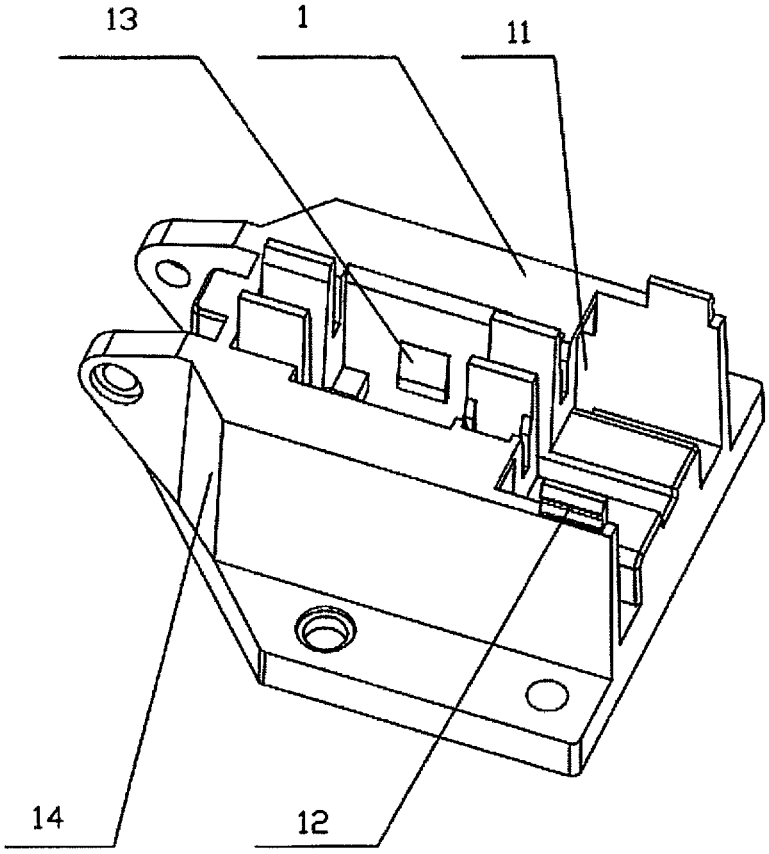
FIG. 6 is a structural schematic diagram of the housing 1 in FIG. 2.

The second contact sheet 4 is V-shaped, contact planes 42 for making contact with the third contact sheet 6 are arranged on two contact legs 41 of the V-shaped second contact sheet 4, the contact planes 42 are in circular arc transition with the contact legs 41 of the second contact sheet 4, wave-shaped contact portions 61 are arranged on the third contact sheet 6, and ends of the contact portions 61 bend outwards (the mentioned inward or outward bending may be referred to FIG. 5, and a central line of the mounting seat is taken as a reference). Such structure allows the second contact sheet to make face-contact with the third contact sheet, avoiding excessive heat and unreliable contact due to linear contact. Specifically, an edge 31 that bends inwards is arranged on the first contact sheet 3. Such structure facilitates closing the flip cover, and allows the third contact sheet to communicate the first contact sheet with the second contact sheet faster and more conveniently.

A sliding groove 11 is arranged in the housing 1, a sliding block 7 is arranged in the sliding groove 11, a clamping portion 71 configured to clamp the lamp source to be mounted is arranged on the sliding block 7, and the sliding block 7 is matched with the housing 1 in a slide moving manner. Such structure facilitates clamping a lamp source or lamp tube to be mounted. Specifically, a resetting spring 8 is arranged in the sliding groove 11, one end of the resetting spring 8 is clamped with an inner wall of the sliding groove 11, and the other end of the resetting spring 8 is sleeved on a slide guiding portion 72 of the sliding block 7 and clamped with the sliding block 7. Such structure allows for reliable resetting of the sliding block, is simple in structure, and is convenient to product and process. Such structure facilitates mounting the spring, and avoids that the spring ejects out of the sliding block due to its deformation. More specifically, a position limiting seat 9 is arranged on the housing 1, a position limiting column 91 is arranged on the position limiting seat 9, a position limiting groove 73 is arranged on the sliding block 7, and the position limiting column 91 is inserted into the position limiting groove 73. Such structure facilitates mounting the sliding block and enables the sliding block to reliably slide in the housing, and surely, a position limiting piece may also be arranged on the sliding groove of the housing, avoiding excessive movement of the sliding block.

A barb 12 is arranged on the housing 1, and a clamping groove 51 fitting with the barb 12 is arranged on the flip cover 5. Such structure enables the flip cover to be reliably buckled with the housing when the lamp holder is used. Surely, in actual production, arrangement positions of the barb and the clamping groove may also be inverted, that is, the barb is arranged on the flip cover and the clamping groove is arranged on the housing. Surely, a clamping hole or a clamping block may also be arranged to implement fixed connection of the housing and the flip cover.

A correcting boss 13 is arranged on an inner wall of the housing 1 at the first contact sheet 3. Specifically, an inclined face is arranged on the correcting boss. Such structure facilitates pressing the third contact sheet down, and can also play a certain correction effect to deformation of the third contact sheet during usage, ensuring the third contact sheet to be capable of being reliably connected with the first contact sheet and the second contact sheet.

A wind-guiding inclined face 14 is arranged on the housing 1. The arrangement of the wind-guiding inclined face complies with the aerodynamic principle, plays a guiding effect to circulation of the air flow in the lamp, and is more advantageous to heat dissipation of the lamp source. More specifically, the flip cover 5 is hinged with the housing 1, a wind guiding portion 53 is arranged at a position of the flip cover where the flip cover is hinged with the housing 1 (the wind guiding portion means a portion which plays an effect that a flow direction of wind or fluid is guided), and the wind-guiding inclined face is also arranged at a position of the housing 1 where the housing 1 is hinged with the flip cover 5, that is to say, arranged at an opposite side to a position where the lamp source is inserted. The inclined face can also play a good effect of guiding the air flow, and is advantageous to heat dissipation of the lamp source.

Figure 7:
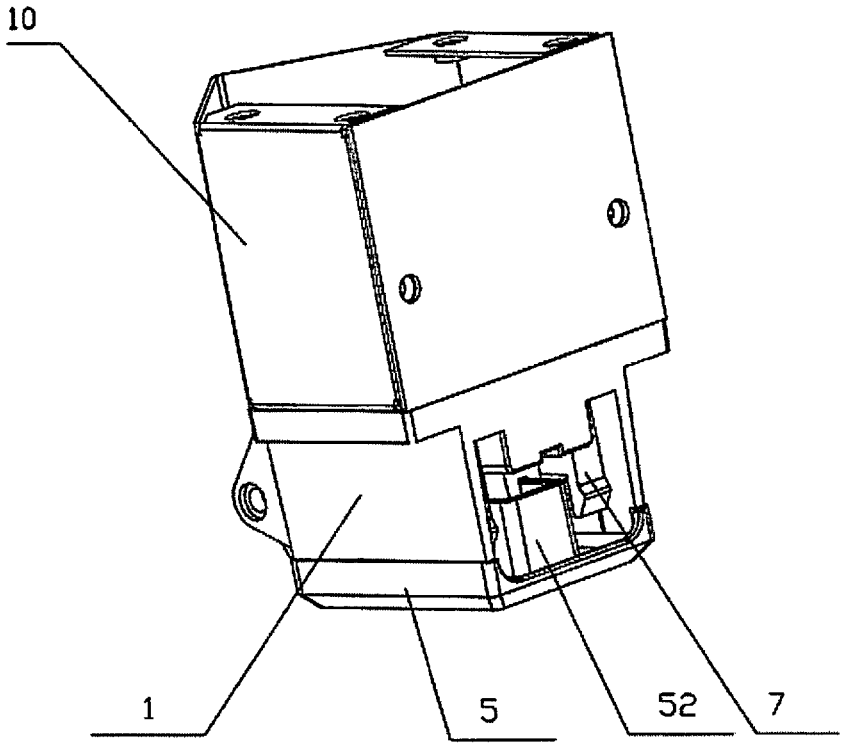
FIG. 7 is a structural schematic diagram of another embodiment according to the disclosure.
Figure 8:
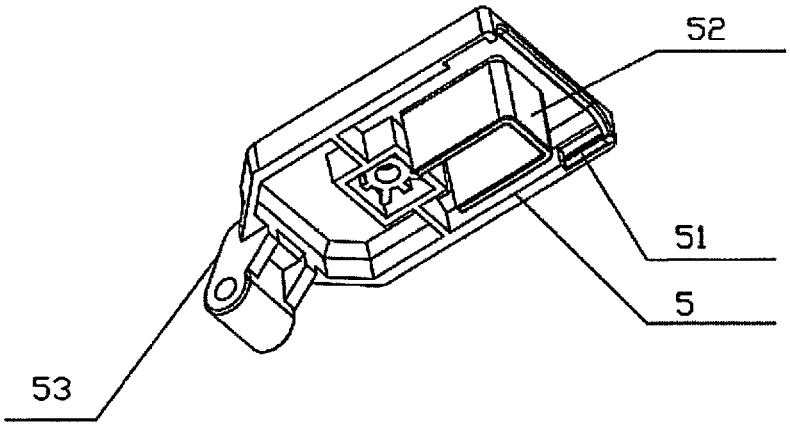
FIG. 8 is a structural schematic diagram of a flip cover 5 in FIG. 7.

Referred to FIGS. 7 and 8, in another embodiment of the disclosure, a U-shaped baffle plate 52 is arranged on the flip cover 5. The arrangement of the U-shaped baffle plate can allow that: when the flip cover is opened, the fingers are prevented from making contact with the binding post or the contact sheets, and especially inadvertent touch and electric shock from children can be avoided. This embodiment is the preferred mode of the disclosure.

It should be known for those skilled that: although the disclosure has been described according to the above embodiments, the inventive concept of the disclosure is not limited to the disclosure, and any modification utilizing the inventive concept would be contained in the protection scope of the patent right of the patent.

The invention claimed is:

1. A double-head lamp holder, comprising a housing, wherein, a mounting seat is arranged in the housing, a first contact sheet and a second contact sheet that is configured to be attached to a binding post of a lamp source to be mounted are arranged on the mounting seat, a turnover flip cover is arranged on the housing, a third contact sheet is arranged on the flip cover, and the flip cover has a first position which is opened, and a second position which allows the third contact sheet to communicate the first contact sheet with the second contact sheet when the flip cover is closed.

2. The double-head lamp holder according to claim 1, wherein, the second contact sheet is V-shaped, contact planes for making contact with the third contact sheet are arranged on two contact legs of the V-shaped second contact sheet, wave-shaped contact portions are arranged on the third contact sheet, and ends of the contact portions bend outwards.

3. The double-head lamp holder according to claim 1, wherein, an edge that bends inwards is arranged on the first contact sheet.

4. The double-head lamp holder according to claim 1, wherein, a sliding groove is arranged in the housing, a sliding block is arranged in the sliding groove, a clamping portion configured to clamp the lamp source to be mounted is arranged on the sliding block, and the sliding block is matched with the housing in a slide moving manner.

5. The double-head lamp holder according to claim 4, wherein, a resetting spring is arranged in the sliding groove, one end of the resetting spring is clamped with an inner wall of the sliding groove, and the other end of the resetting spring is sleeved on a slide guiding portion of the sliding block and clamped with the sliding block.

6. The double-head lamp holder according to claim 4, wherein, a position limiting seat is arranged on the housing, a position limiting column is arranged on the position limiting seat, a position limiting groove is arranged on the sliding block, and the position limiting column is inserted into the position limiting groove.

7. The double-head lamp holder according to claim 1, wherein, a barb is arranged on the housing, and a clamping groove fitting with the barb is arranged on the flip cover.

8. The double-head lamp holder according to claim 1, wherein, a correcting boss is arranged on an inner wall of the housing at the first contact sheet.

9. The double-head lamp holder according to claim 1, wherein, a wind-guiding inclined face is arranged on the housing.

10. The double-head lamp holder according to claim 1, wherein, a U-shaped baffle plate is arranged on the flip cover.

11. A lamp, comprising a lampshade in which a junction box is arranged, wherein, the double-head lamp holder according to claim 1 is arranged on the junction box.

* * * * *